US009505571B2

(12) United States Patent
Kayani

(10) Patent No.: US 9,505,571 B2
(45) Date of Patent: Nov. 29, 2016

(54) BANK NOTE PROCESSING SYSTEM HAVING A HIGH SPEED NOTE PROCESSING PATH

(71) Applicant: Sohail Kayani, Irving, TX (US)

(72) Inventor: Sohail Kayani, Irving, TX (US)

(73) Assignee: Toshiba International Corporation, Houston, TX (US)

( * ) Notice: Subject to any disclaimer, the term of this patent is extended or adjusted under 35 U.S.C. 154(b) by 26 days.

(21) Appl. No.: 14/102,152

(22) Filed: Dec. 10, 2013

(65) Prior Publication Data

US 2015/0158687 A1 Jun. 11, 2015

(51) Int. Cl.

| | |
|---|---|
| ***B65H 5/22*** | (2006.01) |
| ***B65H 7/20*** | (2006.01) |
| ***B65H 5/06*** | (2006.01) |
| ***B65H 5/26*** | (2006.01) |

(52) U.S. Cl.

CPC ..... *B65H 5/228* (2013.01); *B65H 5/062* (2013.01); *B65H 5/26* (2013.01); *B65H 7/20* (2013.01); *B65H 2513/10* (2013.01); *B65H 2515/212* (2013.01); *B65H 2551/10* (2013.01); *B65H 2701/1912* (2013.01)

(58) Field of Classification Search

CPC ..... B65H 5/22; B65H 5/228; B65H 29/24; B65H 29/245; B65H 29/246; B65H 29/247; B65H 29/248; B65H 2301/4431; B65H 2301/44318; B65H 2301/446; B65H 2301/4461; B65H 2406/11; B65H 2406/1132; B65H 2406/12; B65H 2406/122; B65H 2406/13; B65H 2406/131

See application file for complete search history.

(56) References Cited

U.S. PATENT DOCUMENTS

| | | | | |
|---|---|---|---|---|
| 5,988,631 | A | 11/1999 | Hewit | |
| 6,116,595 | A * | 9/2000 | d'Agrella et al. | 271/279 |
| 7,011,307 | B2 * | 3/2006 | Obama et al. | 271/258.01 |
| 7,014,187 | B2 | 3/2006 | Mayerberg, II et al. | |
| 7,121,201 | B2 * | 10/2006 | Landskron et al. | 101/232 |
| 7,175,029 | B2 * | 2/2007 | Campagnolle et al. | 209/644 |
| 7,199,323 | B2 * | 4/2007 | Campagnolle et al. | 209/584 |
| 8,092,143 | B2 * | 1/2012 | Yang et al. | 414/676 |
| 8,317,194 | B2 * | 11/2012 | Werner et al. | 271/264 |

* cited by examiner

*Primary Examiner* — Ernesto Suarez
(74) *Attorney, Agent, or Firm* — Baker Botts L.L.P.

(57) ABSTRACT

A method and system for high speed processing of bank notes in a bank note processing system using air flow is disclosed. The bank note processing system includes a conveyance device having a roller and an air jet. A bank note is directed along a bank note transport path by the roller. The air jet directs air flow to the bank note transport path. The air flow is directed to the bank note transport path in the same direction as direction of travel of the bank note and the air flow and the roller operate together to move the bank note along the bank note transport path.

13 Claims, 3 Drawing Sheets

BANK NOTE PROCESSING SYSTEM HAVING A HIGH SPEED NOTE PROCESSING PATH

BACKGROUND OF THE INVENTION

1. Field of the Invention

The present invention relates to automated currency processing and, more specifically, to a method and system for high speed processing of bank notes in a bank note processing system using air flow.

2. Description of Related Art Including Information Disclosed Under 37 CFR 1.97 and 1.98

Automated currency processors are common in the fields of bulk currency processing and are typically used by central banks, large commercial banks, print works, cash in transit, or other entities that require processing of large amounts of currency.

In operation, bank notes that require processing are fed into the automated currency processing machine by a feeder. The term "bank note" as used herein may generally include bills of different currencies, checks, or other instruments that are typically processed by a banking entity. The bank notes then travel down a conveyor past a number of detector modules which detect various characteristics of the bank note. For instance, the detector modules may determine denomination, authenticity, bank note condition, or other desired characteristics of a bank note. Based on the characteristics detected, the bank note may then be routed to a number of different pockets for collation or destruction. These pockets may enable the automated currency processing machine to sort notes by fitness level, denomination, origin, authentication, or other desired characteristics.

However, in a typical currency processing machine, the speed at which a bank note can move along the conveyor may be limited by air resistance. Specifically, if the conveyor speed is too high and the bank notes are moved too quickly the bank notes may move out of place or fold due to air resistance. The displacement of the bank notes or bank notes folding can disrupt the bank note processing operation and may cause a system malfunction.

BRIEF DESCRIPTION OF THE SEVERAL VIEWS OF THE DRAWING(S)

The present invention will be more fully understood by reference to the following detailed description of the preferred embodiments of the present invention when read in conjunction with the accompanying drawings, in which like reference numbers refer to like parts throughout the views, wherein.

Figure 1:
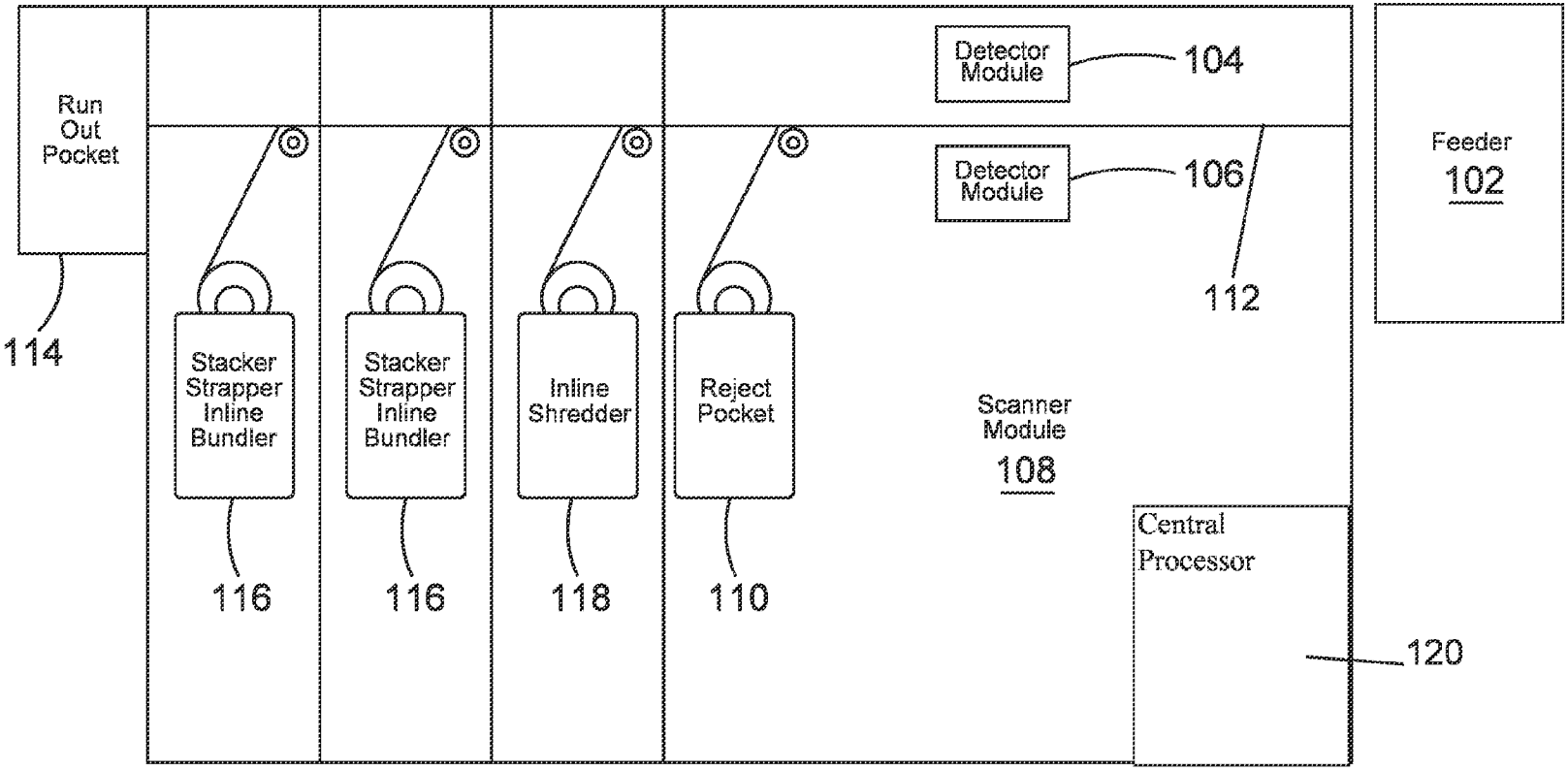
FIG. 1 depicts a block diagram of a basic bank note processing machine, illustrating the location of detectors within the processing stream.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

DETAILED DESCRIPTION OF THE INVENTION

Illustrative embodiments of the present disclosure are described in detail herein. In the interest of clarity, not all features of an actual implementation may be described in this specification. It will of course be appreciated that in the development of any such actual embodiment, numerous implementation specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure. To facilitate a better understanding of the present disclosure, the following examples of certain embodiments are given. In no way should the following examples be read to limit, or define, the scope of the disclosure.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), flash memory; and/or any combination of the foregoing.

The terms "couple" or "couples" as used herein are intended to mean either an indirect or a direct connection. Thus, if a first device couples to a second device, that connection may be through a direct connection, or through an indirect mechanical or electrical connection via other devices and connections. Similarly, if a first device is communicatively coupled to a second device, the two devices may be able to communicate with one another directly or indirectly over any suitable wired or wireless communication network. The details of operation of such wired or wireless communication networks are well known to those of ordinary skill in the art and will therefore not be discussed in detail herein.

FIG. 1 depicts a block diagram of a bank note processing machine according to one embodiment of the present disclosure, highlighting the location of the detectors with respect to the processing stream. A bank note is first stripped from a stack of notes in the feeder (102) and sent along a transport path (112) to the scanner module (108). Within the scanner module (108) is an area centered on the transport path (112) in which one or more detectors may be located. The detectors (104, 106) may be any suitable detectors known to those of ordinary skill in the art, having the benefit of the present disclosure. For instance, in certain illustrative embodiments, the detectors (104, 106) may be optical detectors which may check the bank note for soiling. As would be appreciated by those of ordinary skill in the art, with the benefit of this disclosure, other detectors such as optical detectors and/or ultrasonic detectors may also be included in the scanner module (108) in order to identify damaged bank notes or other desirable characteristics. As discussed in more detail below, if it is determined that the bank note is soiled beyond a preset threshold, it may be marked accordingly and be directed to a special pocket (110) for replacement or otherwise removed from the processing stream and placed into a reject pile.

Moreover, although two detectors (104, 106) are shown in FIG. 1, the present disclosure is not limited to any specific number of detectors. Accordingly, fewer or more detectors may be used without departing from the scope of the present disclosure.

The bank notes may travel along the transport path (112) past the detectors (104, 106). The bank notes are then directed to a final disposition component, which may comprise a pocket (114) for collection of processed bank notes, one or more strappers (116) for strapping the bank notes in bundles, and a means for depositing the bank notes into the pocket by pulling the bank notes from the transport path (112) or transport device. For instance, in certain implementations, soiled bank notes identified by the detectors (104, 106) may be directed to a designated reject pocket (110) where they may be replaced with new bank notes and then be rejected or they may be directed to an inline shredder (118) where they are shredded.

Processing of the bank notes may be controlled by a central processor (120), which may be an information handling system that controls the timing of the system as well as activation of the detectors and note disposition. The central processor (120) may either be a single processing unit or it may consist of multiple processors. Computer-readable media may also be present and associated with the central processor (120), providing storage capacity for the computer code which controls the processor's actions as well as other parameters relating to operation of the system. The central processor (120) is capable of running the stored program steps from the accessible memory. As discussed above, the information handling system acting as the central processor (120) may be a dedicated general purpose computer, an embedded RISC or CISC computer processor, a DSP, or the like.

Figure 2:
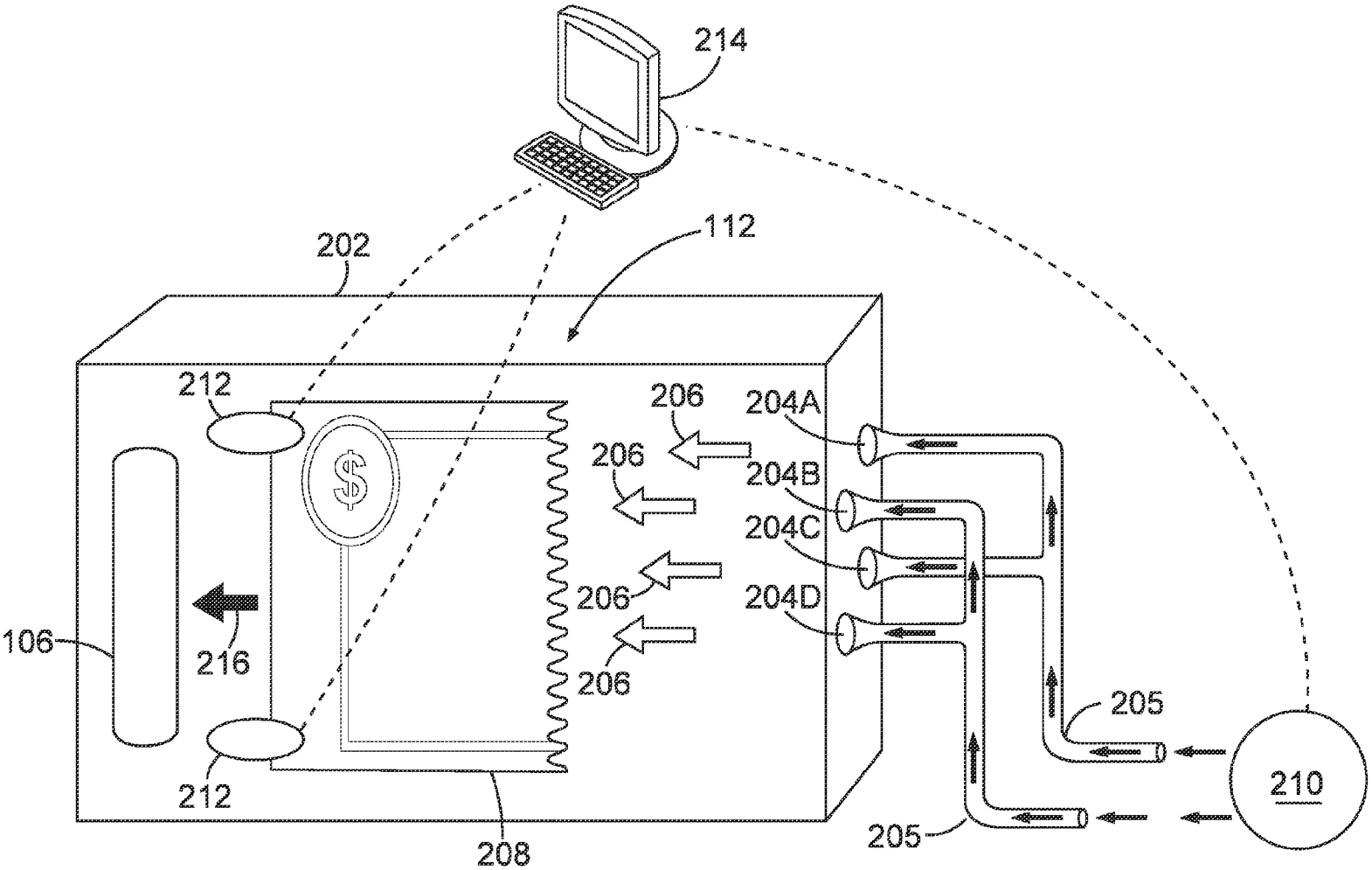
FIG. 2 depicts a side cross-sectional view of an Improved Bank Note Transport Path in accordance with an illustrative embodiment of the present disclosure.

FIG. 2 depicts a close up cross-sectional view of an Improved Bank Note Transport Path ("IBNTP") (112) in accordance with an illustrative embodiment of the present disclosure. In certain illustrative embodiments, the IBNTP (112) may be disposed within a solid fence (202) which forms an enclosed path. As shown in FIG. 2, the detectors such as detector (106) may be formed integrally with the enclosed path and may be coupled to the solid fence (202). Accordingly, although only one of the detectors (106) is shown in FIG. 2, the other detectors and the remaining modules of the bank note processing machine may be similarly coupled and/or integrally formed with the solid fence (202) such that the solid fence (202) creates an enclosed path throughout the bank not processing machine. Specifically, the enclosed path created by the solid fence (202) and depicted and discussed in conjunction with FIGS. 2 and 3 below extends through the portions of the bank note processing machine where a bank note travels.

The solid fence (202) may be made from any suitable materials known to those of ordinary skill in the art, including, but not limited to, Stainless Steel or polished Aluminum. A plurality of air jets (204A-D) may direct air flow into the IBNTP (112) as shown by the arrows (206). Although four air jets are depicted in the illustrative embodiment of FIG. 2, the present disclosure is not limited to any specific number of air jets. Accordingly, fewer or more air jets (204) may be used without departing from the scope of the present disclosure. Moreover, although the bank note 208 is oriented perpendicular to the IBNTP (112) in the illustrative embodiment of FIGS. 2 and 3, the present disclosure is not limited to any specific orientation of the bank note. Accordingly, in certain implementations the bank note (208) may be oriented so that it is disposed parallel to the transport path (112) without departing from the scope of the present disclosure.

Air may be directed to the air jets (204A-D) from an air supply unit (210) through one or more air supply ducts (205). The air supply unit (210) may be any suitable air supply device known to those of ordinary skill in the art, having the benefit of the present disclosure, including, but not limited to, a compressor or a blower.

Figure 3:
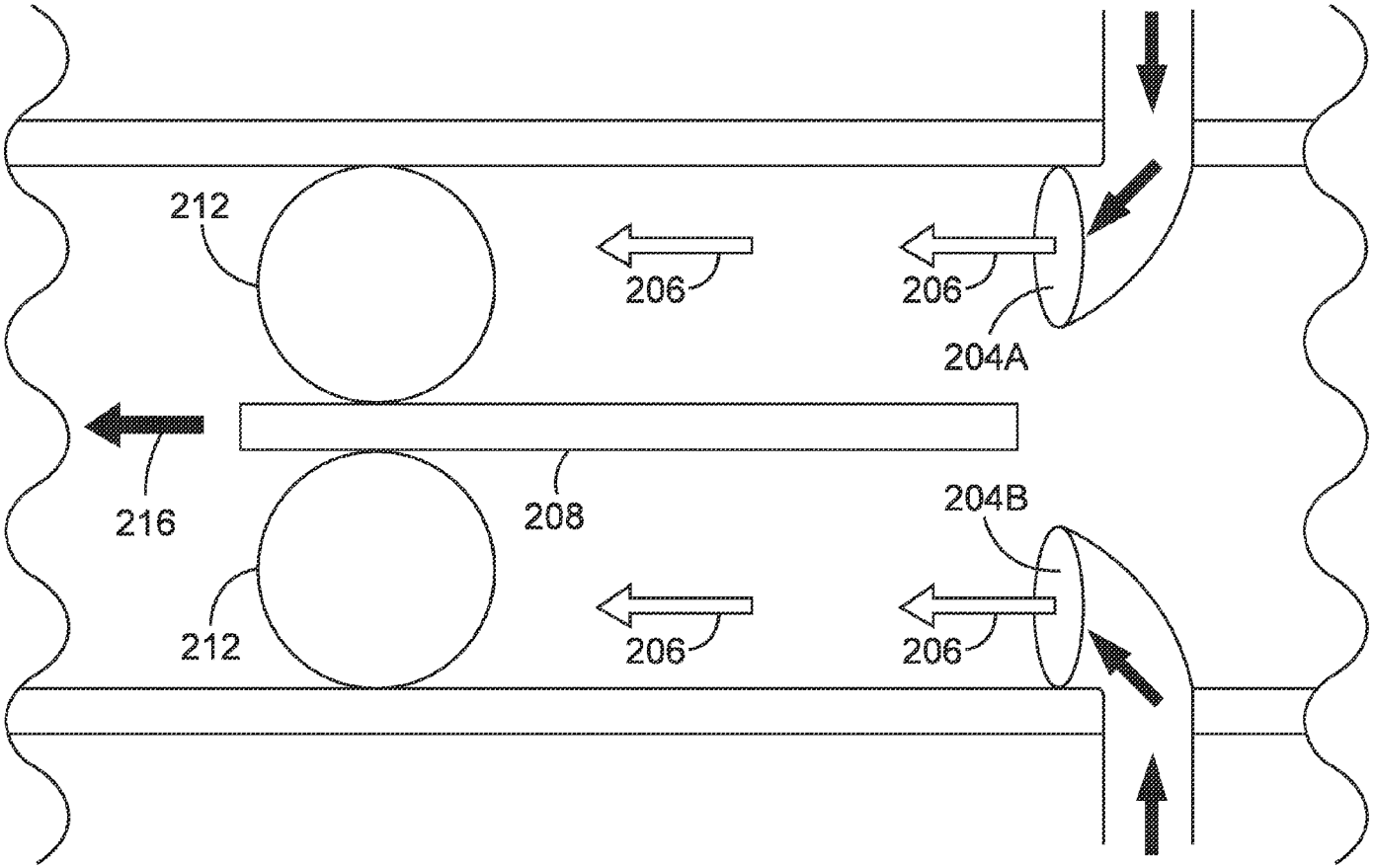
FIG. 3 depicts a top cross-sectional view of the Improved Bank Note Transport Path of FIG. 2.

FIG. 3 shows a cross-sectional top view of the IBNTP (112) of FIG. 2. As shown in FIGS. 2 and 3, the air flow (206) from the air jets (204A) and (204B) is directed to opposing sides of a bank note (208) being transported through the IBNTP (112). Specifically, in certain illustrative embodiments, the air jets (204A-D) may be organized in pairs with each air jet of each pair (e.g., 204A and 204B) disposed on opposing sides of the bank note (208) travelling along the IBNTP (112). Each air jet of the air jet pair may then direct air to one of the two surfaces of the bank note (208) as shown in FIG. 3. This air flow (206) is directed in the same direction as the direction in which the bank note (208) is travelling (as shown by arrow 216) and assists in moving the bank note along the transport path of the IBNTP (112) towards the detectors (104, 106). Accordingly, the air flow (206) and the rollers (212) operate together to move the bank note (208) along the IBNTP (112). Specifically, the rollers (212) move the bank note (208) and the air flow (206) assists in transporting the bank note (208) by overcoming or mitigating the effect of air resistance as discussed in more detail below.

The air flow (206) generated by the air jets (204A-D) may be used to overcome and/or mitigate the effect of air resistance faced by the bank note (208) as the speed of the rollers (212) that move the bank note (208) in the IBNTP (112) is increased to increase bank note processing speed through the system. Specifically, with the increase in the speed of the rollers (212) the air resistance faced by the bank note (208) increases. In response, the air flow (206) generated by the air jets (204A-D) may also be increased proportionally to offset the effect of air resistance. Because the air flow (206) is applied in the direction of bank note (208) movement (shown by arrow 216), the relative speed of the bank note (208) compared to the surrounding air can remains the same, while the absolute processing speed can be increased by increasing the speed of the rollers (212). Specifically, because the air flow (206) offsets the effect of air resistance, the speed of the rollers (212) that move the bank note (208) can be increased without the air resistance causing bank note folding, bank note displacement, or other malfunctions.

In certain illustrative embodiments, the operation of the rollers (212) and the air supply unit (210) may be controlled by an information handling system (214). Specifically, the information handling system (214) may adjust the air flow (206) in response to changes in the roller speed to optimize system performance as described further below. In certain implementations, the information handling system (214) may be the central processor (120) discussed above.

Accordingly, the information handling system (214) may regulate the amount of air supplied by the air supply unit (210) in direct proportion to the speed of the rollers (212). Specifically, the information handling system (214) may be communicatively coupled to the rollers (212) and to the air supply unit (210). As the speed of the rollers (212) increases increasing the speed at which the bank notes (208) are moving through the IBNTP (212), the information handling system (214) may instruct the air supply unit (210) to proportionally increase the air flow (206) directed into the enclosed bank note transport path by the air jets (204A-D). Accordingly, the information handling system (214) can be used to regulate the air flow generated by the air supply unit (210) and directed into the enclosed bank note transport path by the air jets (204A-D) in order to ensure that the air flow (206) offsets the increase in air resistance faced by the bank note as the speed of the rollers (212) increases.

Similarly, in certain illustrative operations, the information handling system (214) may be used to reduce the air flow (206) generated by the air supply unit (210) in response to a reduction in the speed of the rollers (212) to ensure the smooth operation of the device as it processes bank notes (208).

In certain implementations, instead of (or in addition to) regulating the amount of air generated by the air supply unit (210), the information handling system (214) may be communicatively coupled to the air jets (204A-D) or the air supply ducts (205) in order to regulate the amount of air flow (206) into the IBNTP (112). For instance, in certain implementations, the air jets (204A-D) or the air supply ducts (205) may include one or more valves (not shown) that regulate air output through the air jets (204A-D). The information handling system (214) may be communicatively coupled to these valves and may open and close the valves to achieve a desired air flow through the system.

In certain illustrative embodiments, the information handling system may be coupled to a computer-readable medium. A user may determine the optimal amount of air flow (206) in the system for different roller (212) speeds. Such optimal values may be calculated or may be experimentally determined by the user. The optimal air flow for given roller speeds may then be stored in the computer-readable medium. The information handling system (214) may then monitor the speed of the roller (212) and for any given speed, may regulate the air supply unit (210) and/or the air jets (204A-D) to ensure that the optimal air flow (206) for that roller speed is supplied to the IBNTP (112).

Moreover, in certain implementations, the user may initially set the desirable air flow for different roller speeds to optimize system performance. The information handling system (214) may then monitor the user settings for air flow corresponding to different roller speeds and "learn" the desired air flow (206) for different roller speeds from monitoring the user activities and may itself store the optimal air flow (206) for different roller speeds in a computer-readable medium accordingly. This "learned" relationship between the desired air flow (206) for different roller speeds may then be used by the information handling system (214) to regulate air flow (206) and optimize system performance. In the same manner, the information handling system may learn/adjust the optimal air flow (206) for different media that may be processed through the IBNTP (112).

Accordingly, the combination of a roller mechanism with an air flow mechanism facilitates an increase in the bank note processing speed while eliminating malfunctions caused by the bank notes folding or being displaced due to air resistance. This integrated operation of the air flow mechanism with the rollers to transport the bank notes can optimize the speed and performance of the currency processing machine.

Therefore, the present invention is well-adapted to carry out the objects and attain the ends and advantages mentioned as well as those which are inherent therein. While the invention has been depicted and described by reference to exemplary embodiments of the invention, such a reference does not imply a limitation on the invention, and no such limitation is to be inferred. The invention is capable of considerable modification, alternation, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects. The terms in the claims have their plain, ordinary meaning unless otherwise explicitly and clearly defined by the patentee.

I claim:

1. A bank note processing system having a conveyance device comprising:

an enclosed bank note transport path;

a roller within the enclosed bank note transport path, wherein a bank note is directed along the bank note transport path by the roller;

an air jet within the enclosed bank note transport path downstream from the roller, wherein the air jet directs air flow to the bank note transport path and the roller, wherein the air flow is directed to the bank note transport path in same direction as direction of travel of the bank note;

wherein the air flow directs the bank note to the roller to move the bank note along the bank note transport path; and a controller coupled to the air jet and the roller wherein the controller regulates the amount of air supplied by the air jet in direct proportion to a speed of the roller such that the air flow at least partially overcomes increased air resistance faced by the bank note as the note is moved by the roller and as the speed of the roller increases.

2. The bank note processing system of claim 1, further comprising an air supply duct, wherein the air supply duct supplies air to the air jet.

3. The bank note processing system of claim 2, further comprising an air supply unit, wherein the air supplied by the air supply duct to the air jet is generated by the air supply unit.

4. The bank note processing system of claim 3, wherein the air supply unit is selected from a group consisting of a blower and a compressor.

5. The bank note processing system of claim 1, wherein the enclosed bank note transport path comprises a solid fence.

6. The bank note processing system of claim 5, further comprising a detector coupled to the solid fence.

7. A method of processing a bank note through a bank note processing machine comprising:

directing air flow into a bank note transport path from an air jet towards a roller, wherein the air flow is directed into the bank note transport path in same direction as direction of travel of the bank note; and engaging the bank note by the roller, wherein the roller and the air flow operate together to move the bank note along the bank note transport path; and regulating the amount of air supplied by the air jet in direct proportion to a speed of the roller such that the air flow at least partially overcomes increased air resistance faced by the bank note as the note is moved by the roller and as the speed of the roller increases.

8. The method of claim 7, further comprising supplying air to the air jet through an air supply duct.

9. The method of claim 8, further comprising generating air to the air supply duct from an air supply unit.

10. The method of claim 9, further comprising:

communicatively coupling an information handling system to the roller and the air supply unit; and regulating the air flow generated by the air supply unit in proportion to the roller speed using the information handling system.

11. A bank note processing system comprising:

a solid fence forming an enclosed bank note transport path;

a plurality of rollers, wherein the rollers are operable to move a bank note through the enclosed bank note transport path;

a pair of air jets comprising a first air jet and a second air jet directing the bank note towards the rollers, wherein the first air jet directs air flow to a first surface of the bank note in the enclosed bank note transport path and the second air jet directs air flow to a second surface of the bank note in the enclosed bank note transport path; and a controller coupled to the air jets and the rollers wherein the controller regulates the amount of air supplied by the air jet in direct proportion to a speed of the roller such that the air flow at least partially overcomes increased air resistance faced by the bank note as the note is moved by the rollers and as the speed of the rollers increases; and wherein the plurality of rollers and the air flow from the pair of air jets operate together to move the bank note along the enclosed bank note transport path.

12. The bank note processing system of claim 11, wherein the controller regulates at least one of a valve of the pair of air jets and an air supply unit that supplies air to the pair of air jets.

13. The bank note processing system of claim 11, further comprising an air supply unit, wherein the air supply unit supplies air to the pair of air jets.

* * * * *